US006898921B2

(12) United States Patent
Duffield

(10) Patent No.: US 6,898,921 B2
(45) Date of Patent: May 31, 2005

(54) WATER-SOLUBLE THERMOFORMED CONTAINERS COMPRISING AQUEOUS COMPOSITIONS

(75) Inventor: Paul John Duffield, East Yorkshire (GB)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 10/362,551

(22) PCT Filed: Aug. 23, 2001

(86) PCT No.: PCT/GB01/03790

§ 371 (c)(1),
(2), (4) Date: Jun. 20, 2003

(87) PCT Pub. No.: WO02/16205

PCT Pub. Date: Feb. 28, 2002

(65) Prior Publication Data

US 2003/0228433 A1 Dec. 11, 2003

(30) Foreign Application Priority Data

Aug. 25, 2000 (GB) ..... 0021113

(51) Int. Cl.[7] ..... B65B 5/02

(52) U.S. Cl. ..... 53/452; 53/453; 53/454; 53/560

(58) Field of Search ..... 53/452, 453, 454, 53/560

(56) References Cited

U.S. PATENT DOCUMENTS

| | | | | | |
|---|---|---|---|---|---|
| 1,164,141 | A | * | 12/1915 | Mansell de May | 502/337 |
| 3,625,794 | A | * | 12/1971 | Arikawa et al. | 156/244.23 |
| 4,215,169 | A | * | 7/1980 | Wysong | 428/220 |
| 4,493,807 | A | * | 1/1985 | Vyvial et al. | 264/101 |
| 4,621,483 | A | | 11/1986 | Magid | 53/455 |
| 4,973,416 | A | | 11/1990 | Kennedy | 252/90 |
| 5,102,950 | A | * | 4/1992 | Terada et al. | 525/60 |
| 5,224,601 | A | | 7/1993 | Gouge et al. | 206/524.7 |
| 5,234,615 | A | | 8/1993 | Gladfelter et al. | 252/90 |
| 5,351,831 | A | | 10/1994 | Gouge et al. | 206/524.7 |
| 5,617,710 | A | * | 4/1997 | Goossens et al. | 53/471 |
| 6,274,246 | B1 | | 8/2001 | Eggers et al. | 428/474.4 |
| 6,378,274 | B1 | * | 4/2002 | Harbour | 53/453 |

FOREIGN PATENT DOCUMENTS

| | | |
|---|---|---|
| EP | 0 518 689 A1 | 12/1992 |
| EP | 0 524 721 A1 | 1/1993 |
| EP | 0 608 910 A1 | 8/1994 |
| EP | 0 937 576 A2 | 8/1999 |
| WO | 93 08095 | 4/1993 |
| WO | 94 14941 | 7/1994 |

OTHER PUBLICATIONS

PCT International Search Report, dated Nov. 22, 2001, for PCT/GB01/03790.
GB Search Report, dated Jan. 23, 2001, for GB 0021113.6.

* cited by examiner

*Primary Examiner*—Scott A. Smith
*Assistant Examiner*—Brian Nash
(74) *Attorney, Agent, or Firm*—Norris, McLaughlin & Marcus

(57) ABSTRACT

A process for preparing a water-soluble container which comprises: a) thermoforming a first poly(vinyl alcohol) film having a water content of less than 5 wt % to produce a pocket; b) filling the pocket with a composition; c) placing a second film on top of the filled pocket; and d) sealing the first film and second film together.

15 Claims, No Drawings

WATER-SOLUBLE THERMOFORMED CONTAINERS COMPRISING AQUEOUS COMPOSITIONS

The present invention relates to a process for preparing water-soluble containers from a poly(vinyl alcohol) (PVOH) film.

It is known to package chemical compositions which may be of a hazardous or irritant nature in water-soluble or water-dispersible materials such as films. The package can simply be added to water in order to dissolve or disperse the contents of the package into the water.

It is known to form water-soluble containers by thermoforming a water-soluble material. For example, WO 92/17382 discloses a package containing an agrochemical such as a pesticide comprising a first sheet of non-planar water-soluble or water-dispersible material and a second sheet of water-soluble or water-dispersible material superposed on the first sheet and sealed to it by a continuous closed water-soluble or water-dispersible seal along a continuous region of the superposed sheets. It is stated to be advantageous to ensure that the package produced is evacuated of air or the contents are under reduced pressure to provide increased resistance to shock.

In fields such as detergents for domestic use, an attractive appearance for an article is extremely desirable. However, in the prior art such as that described above, the packages do not have an attractive appearance. For example, the packages disclosed in WO 92/17382 are likely to have a non-uniform appearance because they are packaged under reduced pressure.

We have discovered that this type of product is not deemed to be attractive by an average consumer.

The present invention seeks to provide a water-soluble container containing a composition, which container has a more attractive appearance. In particular the container should be relatively self-supporting and look full. Ideally the container should have an attractive, rounded three-dimensional appearance.

Commercially available PVOH film is generally prepared by a blown or casting process. In both types of process the film picks up a certain degree of moisture because PVOH is hydroscopic. In general, commercially available film contains around 6 to 14 wt % water, especially about 8 wt % water. When thermoforming containers by the method disclosed in WO 92/17382, the initially thermoformed PVOH pocket shrinks before the pocket can be filled. Thus, even in the short time of around 5 to 20 seconds before the pocket is filled on a commercial production line, the volume of the pocket can diminish by up to 50%.

We have surprisingly discovered that if the PVOH film is substantially anhydrous, that is containing less than 5 wt % water, there is little or no shrinkage. It is therefore possible to fill the pocket to or near the brim without a substantial risk of overflow as the pocket continues to contract. The second sheet of water-soluble material can then be placed on the first sheet and sealed to it. Thus the containers can safely be filled to a greater extent than those described in WO 92/17382, which in itself can impart a significantly more attractive appearance to the containers.

The individual containers thus produced will, after time, start to absorb moisture either from the air or from the composition held within the film if it is an aqueous liquid composition containing free water. Immediately after the containers are prepared, they may be limp if not completely filled. However, after this storage they will develop a more attractive three-dimensional appearance and also appear to look even fuller. They can also be said to have a "puffed-up" appearance. Although not bound by this theory, it is believed that the water in the aqueous composition held within the container or from the atmosphere shrinks the PVOH film, which was stretched during the thermoforming process, around the composition to provide the attractive appearance. In other words the PVOH film attempts to recover its original shape when contacted with the aqueous composition.

Thus the present invention provides a process for preparing a water-soluble container which comprises:

a) thermoforming a first PVOH film having a water content of less than 5 wt % to produce a pocket;

b) filling the pocket with a composition;

c) placing a second film, preferably a PVOH film, on top of the filled pocket; and d) sealing the first film and second film together.

The present invention also provides the use of a thermoformed PVOH film containing less than 5 wt % water to package a composition.

The present invention additionally provides the use of a PVOH film containing less than 5 wt % water and comprising 15 to 20 wt % plasticiser, based on the total weight of the film, to package a composition.

If more than one PVOH film is used, the films may be identical or different. The PVOH film may be partially or fully alcoholised or hydrolysed, for example, it may be from 40 to 100%, preferably 70 to 92%, most preferably about 88% or about 92%, alcoholised or hydrolysed, polyvinyl acetate film. The degree of hydrolysis is known to influence the temperature at which the PVOH starts to dissolve in water. 88% hydrolysis corresponds to a film soluble in cold (i.e. room temperature) water, whereas 92% hydrolysis corresponds to a film soluble in warm water. An example of a preferred PVOH is ethyoxylated PVOH. The film may be cast, blown or extruded. It may also be unorientated, mono-axially oriented or bi-axially oriented.

It is possible for suitable additives such as plasticisers, lubricants and colouring agents to be added to the film. Components which modify the properties of the polymer may also be added. Plasticisers are generally used in an amount of up to 35 wt %, for example from 5 to 35 wt %, preferably from 7 to 20 wt %, more preferably from 10 to 15 wt %. Lubricants are generally used in an amount of 0.5 to 5 wt %. The polymer is therefore generally used in an amount of from 60 to 94.5 wt %, based on the total amount of the composition used to form the film. Suitable plasticisers are, for example, pentaerythritols such as depentaerythritol, sorbitol, mannitol, glycerine and glycols such as glycerol, ethylene glycol and polyethylene glycol. Solids such as talc, stearic acid, magnesium stearate, silicon dioxide, zinc stearate or colloidal silica may also be used.

It is also possible to include one or more particulate solids in the films in order to accelerate the rate of dissolution of the container. This solid may also be present in the contents of the container. Dissolution of the solid in water is sufficient to cause an acceleration in the break-up of the container, particularly if a gas is generated, when the physical agitation caused may, for example, result in the virtually immediate release of the contents from the container. Examples of such solids are alkali or alkaline earth metal, such as sodium, potassium, magnesium or calcium, bicarbonate or carbonate, in conjunction with an acid. Suitable acids are, for example, acidic substances having carboxylic or sulfonic acid groups or salts thereof. Examples are cinnamic, tartaric, mandelic, fumaric, maleic, malic, palmoic, citric and naphthalene disulfonic acids.

The film is generally cold water (20° C.) soluble, but may be insoluble in cold water at 20° C. and only become soluble in warm water or hot water having a temperature of, for example, 30° C., 40° C., 50° C. or even 60° C. This parameter is determined in the case of PVOH by its degree of hydrolysis.

It is particularly important to avoid pinholes in the film through which leakage of the contained composition may occur. It may therefore be appropriate to use a laminate of two or more layers of a different or the same film, as pinholes are unlikely to coincide in two layers of material.

Since all commercially available PVOH film contains around 6 to 14 wt % water, it is necessary to take special steps to obtain a film having a water content of less than 5 wt % (herein sometimes referred to as an anhydrous film). A blown PVOH film initially contains a very low proportion of water and can be considered to be anhydrous. However, it rapidly absorbs water from the atmosphere until it contains around 8 wt % water or even more. It is therefore possible to obtain an anhydrous PVOH film by immediately wrapping a blown PVOH film in packaging which prevents moisture absorption, such as a polyethylene film. Another possibility is to carry out the thermoforming process on a PVOH blown film immediately after it has been prepared. A further possibility is to dry a blown or cast PVOH film, by storing it open under reduced humidity conditions, although this may not be commercially economic.

Desirably the PVOH film contains less than 4 wt % water, preferably less than 3 wt %, 2 wt % or 1 wt % water. In general it is difficult to obtain a totally anhydrous PVOH film, but desirably the film contains more than 0.1 wt % water, for example more than 0.5 wt % or more than 1 wt % water, to ensure the film is not too brittle. Most preferably the film contains 0.5 to 1 wt % of water. The amount of water required to ensure that the film is not too brittle depends to a certain extent on the amount of plasticiser in the film.

The method of forming the container is similar to the method described in WO 92/17382 except for using an anhydrous PVOH film. A first PVOH film is initially thermoformed to produce a non-planar sheet containing a pocket, such as a recess, which is able to retain the composition. The pocket is generally bounded by a flange, which is preferably substantially planar. The pocket may have internal barrier layers as described in, for example, WO 93/08095.

The pocket is then filled with the composition. Unlike the process described in WO 92/17382, the pocket does not have to be immediately filled. Since the anhydrous film has a degree of shape and size stability it does not immediately shrink. Once it has been filled with the composition, a second film, preferably a PVOH film, is placed on the flange and across the pocket. The second PVOH film is desirably anhydrous, but need not be. For example it may be a normal PVOH film containing at least 6 wt %, especially around 6 to 14 or 18 wt %, more especially about 8 wt % water. The second PVOH film may or may not be thermoformed. If the first film contains more than one pocket, the second film may be placed across all of the pockets for convenience.

The pocket is desirably completely filled so that the filled containers look full. However, it is possible to leave an airspace of from 2 to 20%, especially from 5 to 10%, of the volume of the container immediately after it is formed. Partial filling may reduce the risk of rupture of the container if it is subjected to shock and may reduce the risk of leakage if the container is subjected to high temperatures.

The films are then sealed together, for example by heat sealing across the flange. A suitable heat sealing temperature is, for example, 120 to 195° C., for example 140 to 150° C. A suitable sealing pressure is, for example, from 250 to 800 kPa. Examples of sealing pressures are 276 to 552 kPa (40 to 80 p.s.i.), especially 345 to 483 kPa (50 to 70 p.s.i.) or 400 to 800 kPa (4 to 8 bar), especially 500 to 700 kPa (5 to 7 bar) depending on the heat sealing machine used. Suitable sealing dwell times are at least 0.4 seconds, for example 0.4 to 2.5 seconds. Other methods of sealing the films together may be used, for example infra-red, radio frequency, ultrasonic, laser, solvent, vibration, electromagnetic, hot gas, hot plate, insert bonding, fraction sealing or spin welding. An adhesive such as water or an aqueous solution of PVOH may also be used. The adhesive can be applied to the films by spraying, transfer coating, roller coating or otherwise coating, or the films can be passed through a mist of the adhesive. The seal desirably is also water-soluble.

The first anhydrous film will generally have a thickness before thermoforming of 20 to 500 μm, especially 70 to 400 μm, for example 70 to 300 μm, most preferably 70 to 160 μm, especially 90 or 110 to 150 μm. The thickness of the second film may be less than that of the first film as the second film will not generally be thermoformed, so localised thinning of the sheet will not occur. The thickness of the second film will generally be from 20 to 150 or 160 μm, preferably from 40 or 50 to 90 or 100 μm, more preferably from 50 to 80 μm. However a film having a thickness of 70 to 150 μm may also be used.

The films may be chosen, if desired, such that they have the same thickness before the first film is thermoformed, or have the same thickness after the first sheet has been thermoformed in order to provide a composition which is encapsulated by a substantially constant thickness of film.

The nature of the composition is not limited. It may, for example, be a solid or a liquid. If it is in the form of a solid it may, for example, be in the form of a powder, granules, an extruded tablet, a compressed tablet or a solidified gel. If it is in the form of a liquid it may be optionally thickened or gelled with a thickener or a gelling agent. One or more than one phase may be present. For example the container may be filled with a liquid composition and a separate solid composition, for example in the form of a ball, pill or speckles. Alternatively two or more solid phases may be present, or two or more immiscible liquid phases.

Thus the composition need not be uniform. For example, during the manufacture the container could first be filled with a settable composition, for example a gel, and then with a different composition such as a liquid, especially an aqueous, composition. The first composition could dissolve slowly, for example in a washing process, so as to deliver its charge over a long period. This might be useful, for example, to provide an immediate, delayed or sustained delivery of a component such as a softening agent.

If the water-soluble container is soluble in cold water at room temperature (20° C.) or slightly above, it is important to ensure that the composition itself does not dissolve the container. In general solid compositions will not attack the container, and neither will liquid organic compositions which contain less than around 5 wt % of water, as described, for example, in WO 92/17382. If the composition is in the form of a liquid containing more than about 5 wt % water, action must be taken to ensure that the composition does not attack the walls of the container. Steps may be taken to treat the inside surface of the film, for example by coating it with an agent such as PVdC (poly(vinylidene dichloride)) or PTFE (polytetrafluoroethylene). A semi-permeable or partial water barrier such as polyethylene or polypropylene or a hydrogel such as a polyacrylate may also be provided as a coating. The coating will simply fall apart or dissolve or disperse into microscopic particles when the container is dissolved in water. Steps may also be taken to adapt the composition to ensure that it does not dissolve the film. For example, it has been found that ensuring the composition has a high ionic strength or contains an agent which minimises water loss through the walls of the container will prevent the composition from dissolving a PVOH film from the inside. This is described in more detail in EP-A-518,689 and WO 97/27743.

The total amount of water in the composition may be more than 5 wt %, for example more than 10, 15, 20, 25 or 30 wt %. The total water content may be less than 80 wt % for example less than 70, 60, 50 or 40 wt %. It may, for example, contain from 30 to 65 wt % total water.

If more than one container is formed at the same time, the packaged compositions may then be separated from each other. Alternatively, they may be left conjoined and, for example, perforations provided between the individual containers so that they can be easily separated at a later stage, for example by a consumer.

If the containers are separated, the flanges may be left in place. However, desirably the flanges are partially removed in order to provide an even more attractive, three-dimensional appearance. Generally the flange remaining should be as small as possible for aesthetic purposes while bearing in mind that some flange is required to ensure the two films remain adhered to each other. A flange of 1 mm to 10 mm is desirable, preferably 2 mm to 7 mm, more preferably 4 mm to 6 mm, most preferably about 5 mm.

The containers may then be left to absorb water from the atmosphere, or may be immediately packaged into boxes for retail sale. The containers may themselves be packaged in outer containers if desired, for example non-water soluble containers which are removed before the water soluble containers are used.

The containers of the present invention generally contain from 5 to 100 g of composition, such as an aqueous composition, especially from 15 to 40 g, depending on their intended use. For example, a dishwashing composition may weigh from 15 to 20 g, a water-softening composition may weigh from 25 to 35 g, and a laundry composition may weigh from 10 to 40 g, especially 20 to 30 g or 30 to 40 g.

The containers may have any shape. For example they can take the form of an envelope, sachet, sphere, cylinder, cube or cuboid, i.e. a rectangular parallelepiped whose faces are not all equal. In general, because the containers are not rigid and are inflated, the sides are not planar, but rather are convex. If the container is formed from a thermoformed film and a planar film, the seam between the two films will appear nearer one face of the container rather than the other. Apart from the deformation of the container due to shrinkage of the PVOH film after the container is manufactured, deformation may also occur at the stage of manufacture if desired. For example, if the pocket is filled with a solid or gelled composition (for example in the form of a tablet) having a height greater than that of the pocket, the second film will be deformed when placed on top of the pocket.

In general the maximum dimension of the filled part of the container (excluding any flanges) is 5 cm. For example, a rounded cuboid container may have a length of 1 to 5 cm, especially 3.5 to 4.5 cm, a width of 1.5 to 3.5 cm, especially 2 to 3 cm, and a height of 1 to 2.5 cm, especially 1 to 2 cm, for example 1.25 to 1.75 cm.

The composition filling the containers is not particularly limited. It can be any composition which is to be added to an aqueous system or used in an aqueous environment. Desirably the composition is a fabric care, surface care or dishwashing composition. For example, the composition may comprise a dishwashing, water-softening, laundry or detergent composition or a rinse aid. In this case it is especially suitable for use in a domestic washing machine such as a laundry washing machine or dishwashing machine. The container may also comprise a disinfectant, antibacterial or antiseptic composition intended to be diluted with water before use, or a concentrated refill composition, for example for a trigger-type spray used in domestic situations. Such a composition can simply be added to water already held in the spray container.

Examples of surface care compositions are those used to clean, treat or polish a surface. Suitable surfaces are, for example, household surfaces such as worktops, as well as surfaces of sanitary ware, such as sinks, basins and lavatories.

The ingredients of the composition depend on the use of the composition. Thus, for example, the compositions may contain surface active agents such as anionic, nonionic, cationic, amphoteric or zwitterionic surface active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$–$C_{20}$ fatty alcohols.

Examples of primary alkyl sulfate surfactants are those of formula:

$$ROSO_3^-M^+$$

wherein R is a linear $C_8$–$C_{20}$ hydrocarbyl group and M is a water-solubilising cation. Preferably R is $C_{10}$–$C_{16}$ alkyl, for example $C_{12}$–$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$–$C_{20}$ alkyl group, preferably $C_{10}$–$C_{18}$ such as a $C_{12}$–$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$–$C_{18}$ fatty acids, especially the sodium, potassium or alkanolammonium salts, and alkyl, for example $C_8$–$C_{18}$, benzene sulfonates.

Examples of nonionic surfactants are fatty acid alkoxylates, such as fatty acid ethoxylates, especially those of formula:

$$R(C_2H_4O)_nOH$$

wherein R is a straight or branched $C_8$–$C_{16}$ alkyl group, preferably a $C_9$–$C_{15}$, for example $C_{10}$–$C_{14}$ or $C_{12}$–$C_{14}$, alkyl group and n is at least 1, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide; and Neodol 91-10, an ethoxylated $C_9$–$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$–$C_{11}$ a fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$–$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-11, which is a similar ethylene oxide condensation products of a fatty alcohol having 14–15 carbon atoms and the number of ethylene oxide groups per mole being about 11. Such products are also available from Shell Chemical Company.

Further nonionic surfactants are, for example, $C_{10}$–$C_{18}$ alkyl polyglycosides, such as $C_{12}$–$C_{16}$ alkyl polyglycosides, especially the polyglucosides. These are especially useful when high foaming compositions are desired. Further surfactants are polyhydroxy fatty acid amides, such as $C_{10}$–$C_{18}$ N-(3-methoxypropyl) glycamides and ethylene oxide-propylene. oxide block polymers of the Pluronic type.

Examples of cationic surfactants are those of the quaternary ammonium type.

Examples of amphoteric surfactants are $C_{10}$–$C_{18}$ amine oxides and the $C_{12}$–$C_{18}$ betaines and sulfobetaines.

The total content of surfactants in a laundry or detergent composition is desirably 60 to 95 wt %, especially 70 to 90 wt %. Desirably, especially in a laundry composition, an anionic surfactant is present in an amount of 50 to 75 wt %, a nonionic surfactant is present in an amount of 5 to 20 wt %, a cationic surfactant is present in an amount of from 0 to 10 wt % and/or an amphoteric surfactant is present in an amount of from 0 to 10 wt %. Desirably in a dishwashing composition, the anionic surfactant is present in an amount of from 0.1 to 50%, a non-ionic surfactant is present in an amount of 0.5 to 20 wt % and/or a cationic surfactant is present in an amount of from 1 to 15 wt %. These amounts are based on the total solids content of the composition, i.e. excluding any water which may be present.

Dishwashing compositions usually comprises a detergency builder. Suitable builders are alkali metal or ammonium phosphates, polyphosphates, phosphonates, polyphosphonates, carbonates, bicarbonates, borates, polyhydroxysulfonates, polyacetates, carboxylates and polycarboxylates such as citrates. The builder is desirably present in an amount of up to 90 wt % preferably 15 to 90 wt %. More preferably 15 to 75 wt %, relative to the total content of the composition. Further details of suitable components are given in, for example, EP-A-694,059, EP-A-518,720 and WO 99/06522.

The compositions, particularly when used as laundry washing or dishwashing compositions, may also comprise enzymes, such as protease, lipase, amylase, cellulase and peroxidase enzymes. Such enzymes are commercially available and sold, for example, under the registered trade marks Esperase, Alcalase, Savinase, Termamyl, Lipolase and Celluzyme by Novo Industries A/S and Maxatasc by International Biosysynthetics, Inc. Desirably the enzymes are present in the composition in an amount of from 0.5 to 3 wt %, especially 1 to 2 wt %.

The compositions may, if desired, comprise a thickening agent or gelling agent. Suitable thickeners are polyacrylate polymers such as those sold under the trade mark CARBOPOL, or the trade mark ACUSOL by Rohm and Haas Company. Other suitable thickeners are xanthan gums. The thickener, if present, is generally present in an amount of from 0.2 to 4 wt %, especially 0.5 to 2 wt %.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, phosphates such as sodium tripolyphosphate or potassium tripolyphosphate, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners and perfumes. If used, such optional ingredients will generally constitute no more than 10 wt %, for example from 1 to 6 wt %, of the total weight of the compositions.

The builders counteract the effects of calcium, or other ion, water hardness encountered during laundering or bleaching use of the compositions herein. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$–$C_{22}$ fatty acids and citric acid. Other examples are organic phosphonate type sequestering agents such as those sold by Monsanto under the trade mark Dequest and alkylhydroxy phosphonates. Citrate salts and $C_{12}$–$C_{18}$ fatty acid soaps are preferred.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan.

The builders generally constitute from 0 to 3 wt %, more preferably from 0.1 to 1 wt %, by weight of the compositions.

Compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 1 wt % of the compositions.

The compositions may optionally comprise materials which serve as phase stabilizers and/or co-solvents. Example are $C_1$–$C_3$ alcohols or diols such as methanol, ethanol, propanol and 1,2-propanediol. $C_1$–$C_3$ alkanolamines such as mono-, di- and triethanolamines and monoisopropanolamine can also be used, by themselves or in combination with the alcohols. The phase stabilizers and for co-solvents can, for example, constitute 0.1 to 1 wt %, preferably 0.1 to 0.5 wt %, of the composition.

If the composition is in liquid form, it may be anhydrous, or, for example, contain up to 5 wt % water. Aqueous compositions generally contain greater than 8 wt % water based on the weight of the aqueous composition. Desirably the aqueous compositions contain more than 10 wt %, 15 wt %, 20 wt %, 25 wt % or 30 wt % water, but desirably less than 80 wt % water, more desirably less than 70 wt %, 60 wt %, 50 wt % or 40 wt % water. They may, for example, contain from 30 to 55 or 65 wt % water.

The compositions may optionally comprise components which adjust or maintain the pH of the compositions at optimum levels. Examples of pH adjusting agents are NaOH and citric acid. The pH may be from, for example, 1 to 13, such as 8 to 11 depending on the nature of the composition. For example, a dishwashing composition desirably has a pH of 8 to 11, a laundry composition desirably has a pH of 7 to 9, and a water-softening composition desirably has a pH of 7 to 9.

The composition may, for example, comprise a component which releases a gas after the container has been sealed which inflates the container to make it look more attractive to a consumer. This component may, for example, comprise a component or a mixture of two or more components which react in the presence of the contents of the container to release the gas. For example, when water is present in the composition, two components which do not react when in solid form but which will react in the presence of water can be added, such as an acid and a carbonate or bicarbonate. An example of a suitable acid is citric acid. Examples of suitable carbonates and bicarbonates are sodium and potassium carbonate and sodium and potassium bicarbonate. If desired, one or more of the components may be encapsulated by a substance which delays the release of the gas.

A further possibility is a component which is a gas at room temperature (20° C.) but which, at the time which it is added, is in the form of a solid or liquid because it has been cooled to lessen its melting or boiling point. For example, solid carbon dioxide (dry ice) may be added. As the component heats up to room temperature, which may occur naturally or be aided with heating, it will boil or sublime into a gas. Another possibility is to add a compound which is thermally unstable; for example sodium bicarbonate will release carbon dioxide when it is heated to about 60° C.

The component which releases a gas may also, for example, be a component which gradually releases a gas such as a bleach, in particular an oxygen bleach or a chlorine bleach. Such a bleach will gradually release a gas such as oxygen or chlorine when it contacts water. The water may itself be contained in the composition, be contained in another compartment and diffuse through the dividing wall into the compartment holding the bleach, or may diffuse into the composition from outside the container.

The gas which is release should desirably be non-toxic or produced in small quantities. It is most convenient, however, to produce carbon dioxide gas since this will not cause any environmental concerns.

The composition may also, for example, be an agricultural composition such as a plant protection agent, for instance a pesticide such as insecticide, acaricide or nematocide, plant growth regulator or a plant nutrient. Such compositions are generally packaged in amounts of from 0.1 g to 7 kg, preferably 1 to 7 kg, when in solid form. When in liquid or gelled form, such compositions are generally packaged in amounts of from 0.1 and to 10 liters, preferably 0.1 to 6 liters, especially from 0.5 to 1.5 liters.

The present invention will now be further explained in the following Examples.

EXAMPLE 1

A dishwashing composition was prepared by mixing together the following components in the weight proportions indicated:

| | |
|---|---|
| Potassium tripolyphosphate powder | 12% |
| Sodium tripolyphosphate powder | 30% |
| Isothiazolinone | 0.1% |
| Polyacrylate thickener (Carbopol) | 1% |
| Nonionic surfactant | 0.5% |
| Sodium citrate | 10% |
| Dehardened water | 46.4% |

A Multivac thermoforming machine operating at 6 cycles/min and at ambient conditions of 25° C. and 35% RH (±5% RH) was used to thermoform an anhydrous PVOH film. The PVOH film was prepared by a blown process from granules provided by PVAXX ref C120 having a degree of hydrolysis of 88% and a thickness of 110 $\mu$m. When formed the PVOH had a negligible water content. The PVOH film was wrapped in a sealed polyethylene container which remained sealed until immediately prior to use. The PVOH film was thermoformed into a rectangular mould of 39 mm length, 29 mm width and 16 mm depth, with the bottom edges being rounded to a radius of 10 mm, at 115–118° C. The thus formed pocket was filled with 17 ml of the dishwashing composition, and an identical film was placed on top and heat sealed at 144–148° C. The thus produced containers were separated from each other by cutting the flanges. Each container was rounded and had a full appearance. After a few hours they attained an even more attractive, rounded appearance.

EXAMPLE 2

The following formulations were prepared by mixing together the indicated components in the weight proportions indicated. In all instances the compositions were filled into containers following the procedure described in Example 1, and containers having an attractive, rounded appearance were obtained.

A Laundry Detergent Composition:

| | |
|---|---|
| Sodium carbonate | 20% |
| Nonylphenol ethoxylate | 10% |
| Accusol 820 obtainable from Rohm and Haas Company | 3.3% |
| Sodium citrate | 5% |
| Dehardened water | 61.7% |

An Automatic Dishwasher Detergent:

| | |
|---|---|
| Sodium citrate | 8% |
| Van Gel ES thickener obtainable from R.T. Vanderbilt Company | 4% |
| Tetrapotassiurn pyrophosphate | 10% |
| Sodium tripolyphosphate | 30% |
| Anhydrous sodium metasilicate | 2% |
| Sodium xylene sulfonate | 2.25% |
| Deceth-4-phosphate | 0.75% |
| Dehardened water | 43% |

A Slurry-Type Heavy Duty Laundry Liquid:

| | |
|---|---|
| Neodol 25-7 $C_{12-15}$ linear alcohol | 18% |
| Biosoft D-62 sodium alkylbenzenesulfonate | 5.5% |
| Sodium carbonate | 2% |
| Anhydrous sodium metasilicate | 5% |
| Tetrasodium pyrophosphate | 20% |
| Sodium citrate | 7.5% |
| Carbopol ETDZE91 polymer obtainable from Goodrich | 0.5% |
| Dehardened water | 41.5% |

A Slurry-Type Laundry Detergent:

| | |
|---|---|
| Sodium carbonate | 40% |
| Sodium citrate | 4.8% |
| Accusol 820 obtainable from Rohm and Haas | 2% |
| Accusol 810 obtainable from Rohm and Haas | 4% |
| Sodium tripolyphosphate | 10% |
| Accusol 445 obtainable from Rohm and Haas | 2% |
| Nonylphenol ethoxylate | 10% |
| Dehardened water | 27.2% |

A Dishwashing Composition:

| | |
|---|---|
| Accusal 810 | 11% |
| Accusol 445N | 4% |
| Sodium tripolyphosphate | 20% |
| Tetrapotassium pyrophosphate | 10% |
| Potassium silicate | 29% |
| Triton CF-32 alkylamine ethoxylate | 3% |

-continued

| | |
|---|---|
| Potassium citrate | 5% |
| Dehardened water | 18% |

What is claimed is:

1. A process for preparing a water-soluble container which comprises:

(a) thermoforming a first polyvinyl alcohol film having a water content of less than 5 wt % and a thickness before thermoforming of 20 $\mu$m to 500 $\mu$m to produce a pocket;

(b) filling the pocket with a composition;

(c) placing a second film on top of the filled pocket; and (d) sealing the first film and second film together.

2. A process according to claim 1 wherein the composition in step (b) is an aqueous liquid.

3. A process according to claim 2 wherein the aqueous liquid comprises at least 8 wt % water based on the total weight of aqueous liquid.

4. A process according to claim 1 wherein the composition is selected from the group consisting of fabric care compositions; surface care compositions, dishwashing compositions, water-softening compositions, laundry compositions, detergent compositions, disinfectant compositions, antibacterial compositions, antiseptic compositions, agricultural compositions and rinse aid.

5. A process according to claim 4 wherein the container is suitable for use in a domestic washing machine.

6. A process according to claim 1 wherein the composition is a refill composition for a trigger-type spray.

7. A process according to claim 1 wherein the second film is a polyvinyl alcohol film.

8. A process according to claim 7 wherein the second polyvinyl alcohol film has a water content of less than 5 wt %.

9. A process according to claim 7 wherein the second polyvinyl alcohol film has a water content of at least 6 wt %.

10. A process according to claim 1 wherein the first polyvinyl alcohol film has a water content of less than 2 wt %.

11. A process according to claim 10 wherein the first poly (vinyl alcohol) film has a water content of 0.5 to 1 wt %.

12. A method of preparing a composition comprising packaging the composition with a thermoformed polyvinyl alcohol film comprising less than 5 wt % water and a thickness before thermoforming of 20 $\mu$m to 500 $\mu$m.

13. The method according to claim 12, wherein the polyvinyl alcohol film comprises less than 2 wt % water.

14. A method of preparing a composition comprising packaging the composition with a polyvinyl alcohol film comprising less than 5 wt % water and a thickness before thermoforming of 20 $\mu$m to 500 $\mu$m and comprising 5 to 35 wt % plasticiser based on the total weight of the film.

15. The method according to claim 14, wherein the polyvinyl alcohol film comprises less than 2 wt % water.

* * * * *